US007952598B2

(12) United States Patent
Rawlings et al.

(10) Patent No.: US 7,952,598 B2
(45) Date of Patent: May 31, 2011

(54) PRINTER WITH DEBRIS CONTROL APPARATUS

(75) Inventors: Timothy W. Rawlings, Waynesville, OH (US); Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 404 days.

(21) Appl. No.: 12/117,054

(22) Filed: May 8, 2008

(65) Prior Publication Data

US 2009/0278883 A1 Nov. 12, 2009

(51) Int. Cl.
*B41J 2/32* (2006.01)

(52) U.S. Cl. ..... 347/171; 400/701

(58) Field of Classification Search ..... 347/171; 400/701, 702

See application file for complete search history.

(56) References Cited

U.S. PATENT DOCUMENTS 5,986,683 A * 11/1999 Sawano et al. ..... 347/171
2003/0112318 A1* 6/2003 Long et al. ..... 347/171

FOREIGN PATENT DOCUMENTS

JP 1-141078 * 6/1989 ..... 400/701
JP 1-141082 * 6/1989 ..... 400/701

* cited by examiner

*Primary Examiner* — Huan H Tran
(74) *Attorney, Agent, or Firm* — Paul W. Martin; Robert S. Chee

(57) ABSTRACT

A printer with debris control apparatus which minimizes printer fouling. The printer includes a print head for printing on media, a platen having a side for feeding the media along a path past the print head, and debris control member in contact with the media.

13 Claims, 4 Drawing Sheets

PRINTER WITH DEBRIS CONTROL APPARATUS

BACKGROUND

Perforation and folding of printable media cause unwanted debris in printers. Debris may include loose coatings, loose fibers, chaff, and dirt. In large enough amounts, this debris may contaminate print heads and drive platens during printing, resulting in print degradation, misfeeding of paper, and complete printer failure. It would be desirable to minimize debris as much as possible.

SUMMARY

A printer with debris control apparatus is provided.

The printer includes a print head for printing on media, a platen having a side for feeding the media along a path past the print head, and debris control member in contact with the media.

In an example embodiment, the debris control member may include a fibrous material having a non-uniform surface and be located upstream of the print head along the path of the media for collecting the debris from the media.

In another example embodiment, the debris control member may include a non-uniform surface on the side of the platen for repelling the debris.

DETAILED DESCRIPTION

By way of example, various embodiments of the invention are described in the material to follow with reference to the included drawings. Variation may be adopted.

Figure 1:
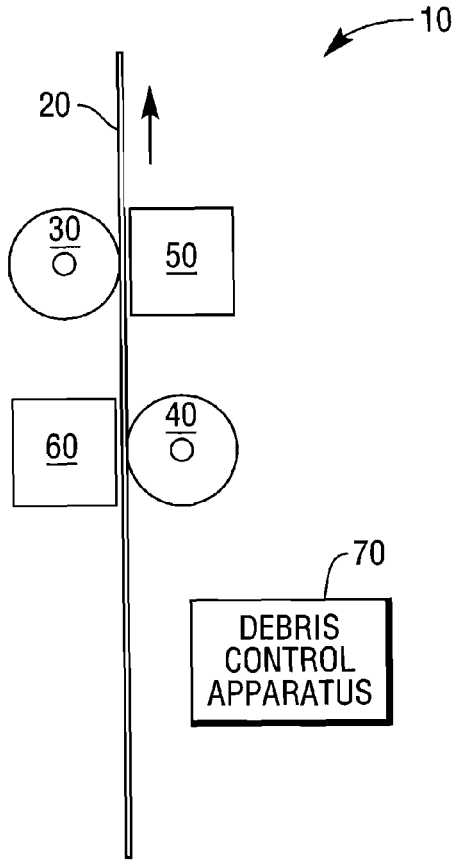
FIG. 1 shows a schematic of an example printer.

With reference to FIG. 1, example printer 10 may include a direct thermal printer. The illustrated printer 10 is useable for printing on two sides of thermal print media 20. However, direct thermal printers which print only on one side of thermal print media 20 are also envisioned.

Printer 10 includes rotating platens 30 and 40 and opposing thermal print heads 50 and 60 on opposite sides of thermal print media 20. Direct thermal printing of thermal print media 20 may occur in a single pass at, for example, completion of a transaction such as when a receipt or ticket is issued. Alternately, direct thermal printing may occur in a two or more pass process where, for example, thermal print media 20 is imaged by one or both thermal print heads 50 and 60 when moving in a first direction, and then retracted for further imaging by one or both thermal print heads 50 and 60 with thermal print media 20 moving in either the first or a second, retract direction. Once printing is completed, thermal print media 20 may, depending on its format (e.g., roll, fan fold, individual sheets, and the like), be manually or automatically cut or severed to provide an individual receipt, ticket, or other document.

Thermal print media 20 includes thermal paper, such a thermal paper having a cellulosic or polymer substrate sheet and heat sensitive dyes. Printing on opposite sides of thermal print media 20 can be facilitated by including a substrate sheet that is sufficiently thermally resistant to inhibit thermal printing on one side of thermal print media 20 from affecting coloration on the opposite side of thermal print media 20.

Thermal print media 20 may be supplied in the form of a paper roll, fan-fold stack, individual sheet and the like, upon which printing such as graphics or text, or both, may be printed on one or both sides of thermal print media 20, to provide, for example, a voucher, coupon, receipt, ticket or other article or document.

Figure 2A:
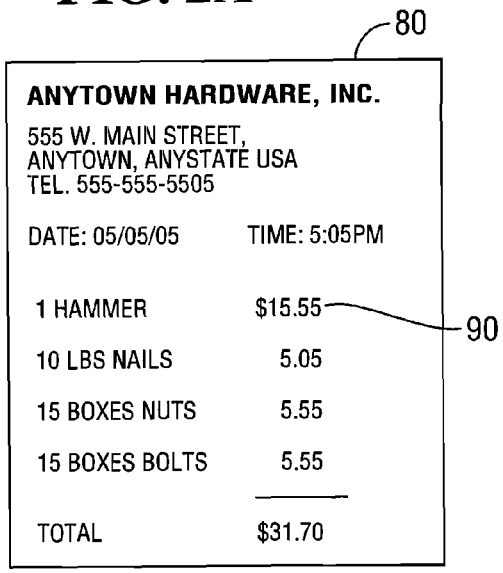
FIGS. 2A and 2B show an example receipt from the printer of FIG. 1.
Figure 2B:
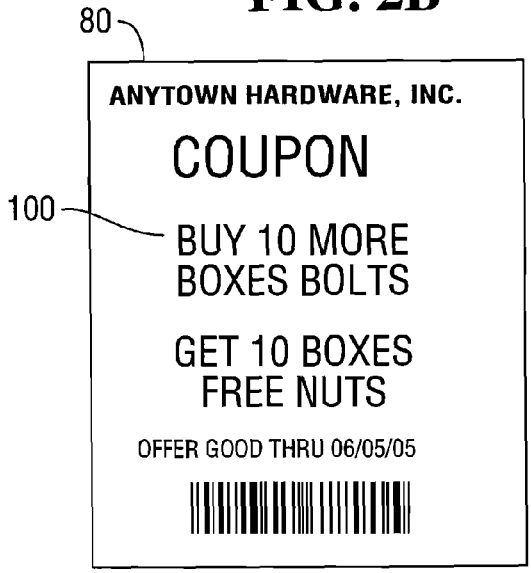

FIGS. 2A-2B show a two-sided thermal document in the form of a receipt 80. With reference to FIG. 2A, receipt 80 includes transaction detail 90 such as issuer identification, time, date, line item entries and a transaction total printed on a first (front) side of receipt 80.

With reference to FIG. 2B, receipt 80 includes custom information 100 printed on a second (back) side of receipt 80 contemporaneous with transaction detail information 90 printed on the front. For example, custom information 100 could include further or duplicate transaction information, a coupon (as shown), rebate or contest information, serialized cartoons, conditions of sale, document images, advertisements, security features, ticket information, legal information such as disclaimers, warranties and the like, or other information. Further, custom information 100 may be targeted based on recipient/purchaser identity, transaction data, transaction detail 90, store inventory or specials, manufacturer inventory or specials, and the like, or randomly selected from a database of possible options, among other means.

Returning to FIG. 1, printer 10 additionally includes a debris control apparatus 70. Debris may include loose coatings, loose fibers, chaff, and dirt from thermal print media 20. Debris control apparatus 70 may control debris in various ways. For example, debris control apparatus 70 may collect and trap the debris prior to printing for later removal during servicing. As another example, debris control apparatus 70 may repel the debris from print platens 30 and 40, so that the debris may be carried out of printer 10 a little at a time by thermal print media 20, with no damage to print heads 50 and 60.

Figure 3:
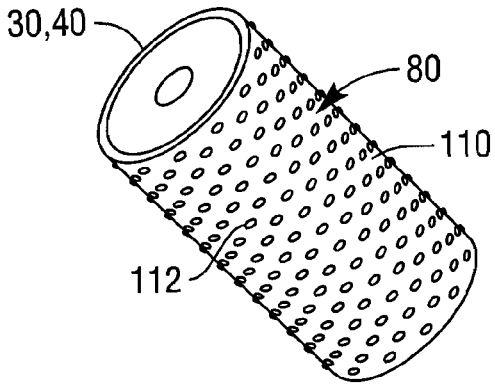
FIG. 3 shows an example embodiment of a debris control apparatus.

In one embodiment, debris control apparatus 70 may include surface features of platens 30 and 40. With reference to FIG. 3, an example embodiment of a platen 30 and 40 includes a non-uniform or textured surface 110. An example type of non-uniform or textured surface feature is stippling 112.

Stippling 112 exposes minimal platen surface area to print media 20 during feeding of print media 20. Stippling 112 is optimally minimized to reduce the amount of platen surface area that touches print media 20 so that platens 30 and 40 collect little or no debris. Debris remains with or attaches to print media 20 and is carried away systematically in undetectable quantities.

Surface 110 may be coated with a repellent, such as polytetrafluoroethylene (PTFE) or silicon. By coating surface 110 with repellant, debris has a desire to stick more to the paper than to platens 30 and 40. Adding repellants to textured surface 110 results in more effective debris control.

In another embodiment, debris control apparatus 70 may include one or more wiping bars 120 located adjacent thermal print media 20.

Figure 5:
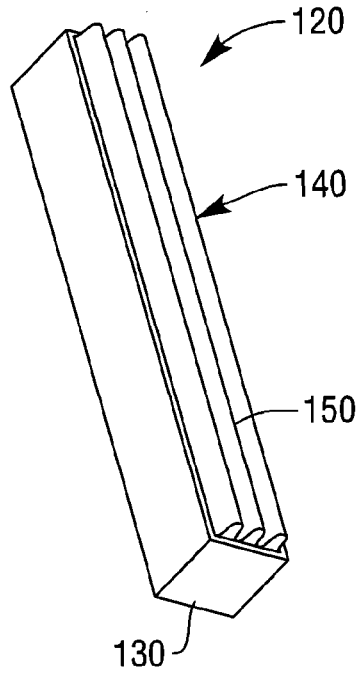
FIG. 5 shows the schematic of FIG. 1 modified to show the example debris control apparatus of FIG. 4.

With reference to FIG. 5, an example of wiping bar 120 includes a housing 130 containing wiping nip 140. Housing 130 may be made of plastic. Wiping nip 140 may include felt or other materials with exposed fibers. Wiping nip 140 may include a non-uniform or textured contact surface 150, for example, have peaks and values, to collect and trap debris. Finally, wiping nip 140 may be impregnated or coated with a cleaning additive, such as silicon, oil, alcohol, and wax.

Figure 4:
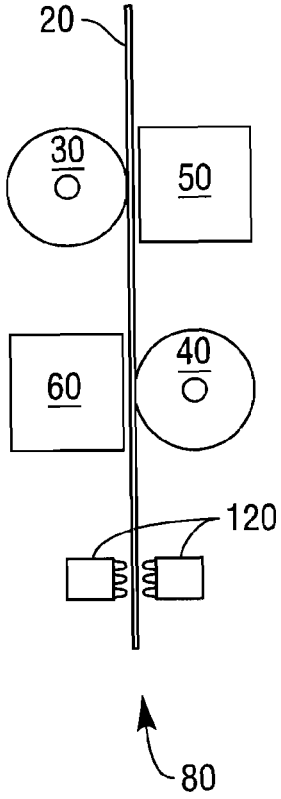
FIG. 4 shows another example embodiment of a debris control apparatus.

With reference to FIG. 4, wiping bars 120 are located upstream of print heads 50 and 60 to remove, collect, and trap debris. Wiping bars 120 may be located on opposite sides of thermal print media 20.

Advantageously, the cleaning additives may also serve as lubricants for the purpose of extending print head life. Print heads 50 and 60 may be made of silica glass, which comes into direct contact with print media 20. Direct contact causes friction and drag which eventually wears away the silica. Lubrication from silicone, wax, and the like coming from the wiping bars extends the life of print heads 50 and 60 by reducing the overall friction.

Figure 6:
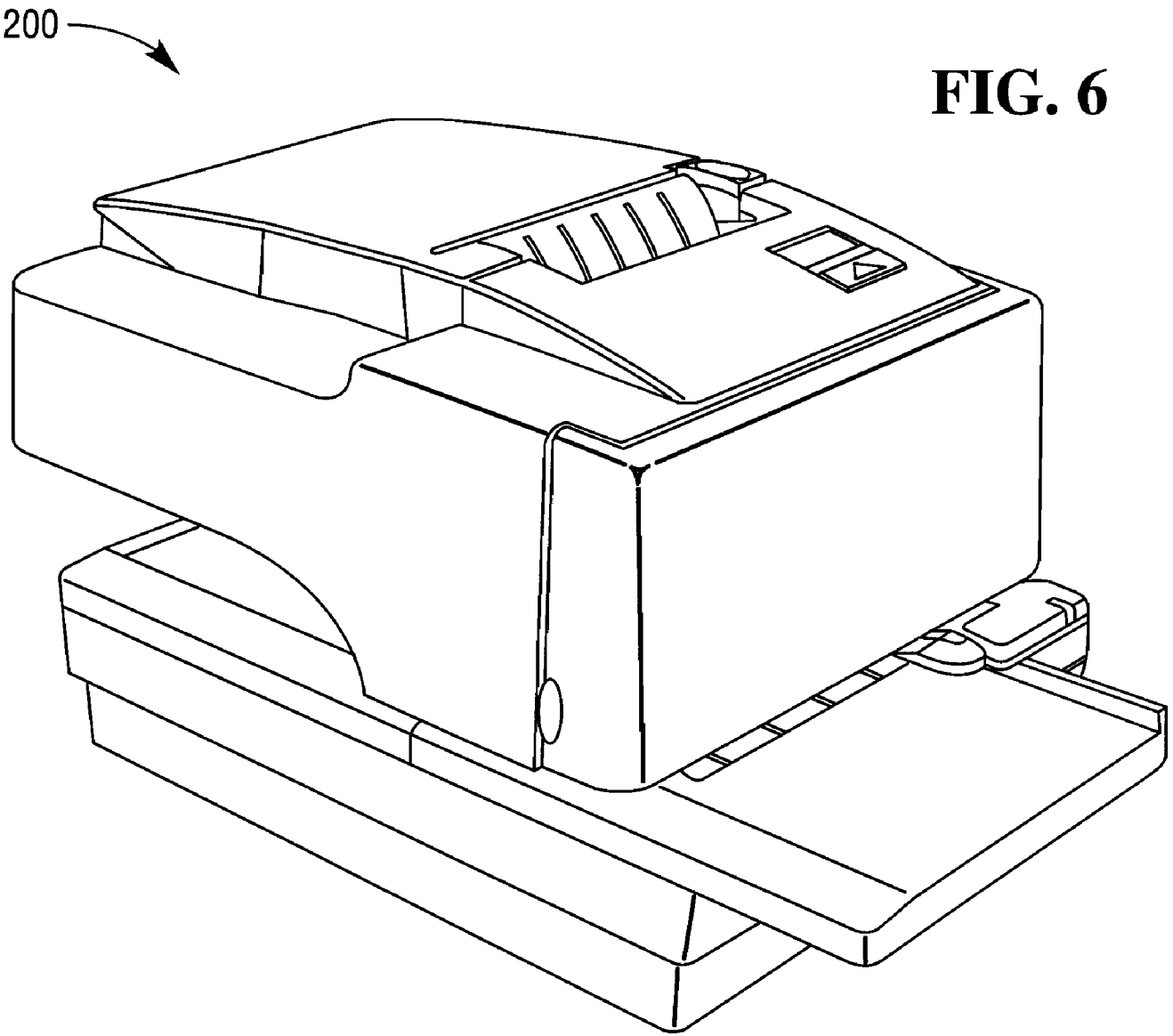
FIG. 6 shows a perspective view of an example printer.
Figure 7:
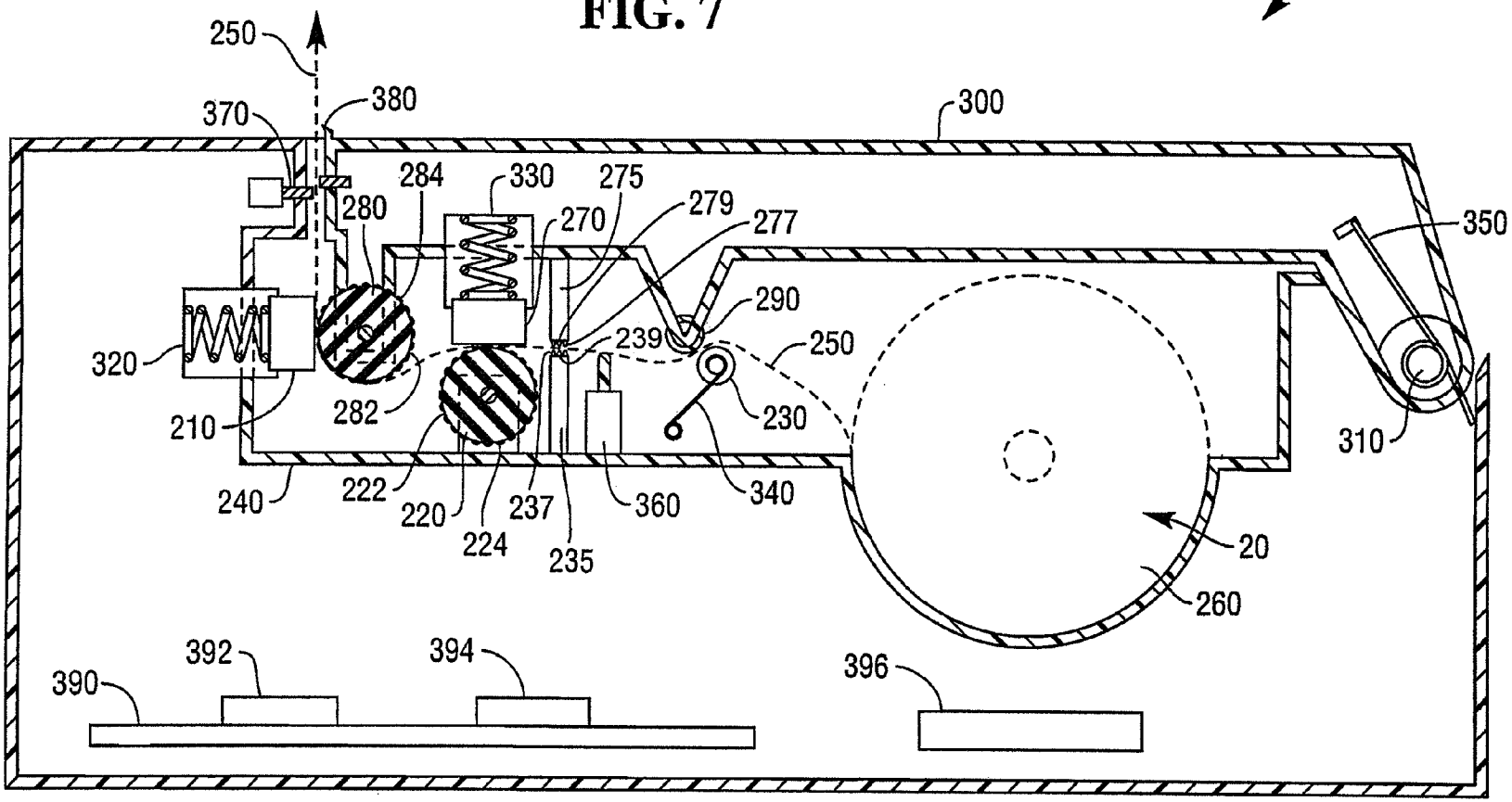
FIG. 7 shows a partial centerline elevation view of the example printer of FIG. 6.

FIGS. 6-7 illustrate an example embodiment of printer 200 for point-of-sale (POS) terminal application. Printer 200 may include one or more embodiments of debris control apparatus 70, including the embodiments illustrated in FIGS. 3 and 5.

With reference to FIG. 7, printer 200 includes a print head 210, a platen 220 and a guide platen 230 all coupled to a supporting arm or base structure 240. Print head 210, platen 220 and guide platen 230 are on one side of feed path 250 of thermal print media 20 taken off a supply roll 260.

Platen 220 may include non-uniform or textured surface 222, including stippling 224, as similarly illustrated in FIG. 3.

Printer 200 may also or alternatively include wiping bar 235 with nip 237 and non-uniform or textured surface 239 as similarly illustrated in FIG. 4.

Printer 200 further includes a print head 270, a platen 280 and a guide platen 290 all coupled to a pivotable supporting arm or cover 300, which pivots about a hinge line 310 to allow, for example, paper replacement and servicing.

Platen 280 may include non-uniform or textured surface 282, including stippling 284, as similarly illustrated in FIG. 3.

Printer 200 may also or alternatively include wiping bar 275 opposed to wiping bar 235 with nip 277 and non-uniform or textured surface 279 as similarly illustrated in FIG. 5.

When arm 300 is in the closed position (as shown), thermal print media 20 may be engaged between print head 210 and opposed platen 280, between print head 270 and opposed platen 220, between opposed wiping bars 235 and 275, and between guide platens 230 and 290. Contact pressures with, and tension of, thermal print media 20 are maintained by, for example, spring loading of the various printer elements using springs 320, 330 and 340.

Printer 200 may further include a spring 350 for pivotable supporting arm or cover 300 to enable opening of the cover 300 at a controlled rate, and thereby avoid, for example, uncontrolled closing of cover 300 through force exerted on cover 300 via the acceleration of gravity. A sensor 360, may further be provided to detect a paper out condition, and produce a signal which can be used to disable printing, notify a POS operator to replace the supply roll 260, and the like. A sensor 360 may also be provided to identify regions of the media for printing, including identifying regions comprising sense marks or other preprinted material.

Printer 200 may further include an electronically activated mechanical cutting or knife blade mechanism 370 to sever the print media upon completion of a print task such as printing of a transaction receipt. A serrated edge 380 may also be included to enable manual severing of the print media at the end of a transaction, when a media print roll is replaced or reloaded, and the like.

Printer 200 further includes control electronics for controlling operation of the printer 200. The control electronics may include a motherboard 390, a microprocessor or CPU 392, and memory 394, including one or more DRAM and/or NVRAM print buffer memory elements. Printer 200 further includes a communications port 396 for communicating with one or more host or auxiliary systems such as a POS terminal for input of data to, and output of data from, printer 200.

Communication controller 396 may support RS-232 serial, parallel, universal serial bus, Ethernet and/or wireless communications (e.g., 802.11, 802.15, and IR), among others. Data for printing would typically be supplied by a host POS terminal communicating with printer 200 via communication controller 396. Supplemental data for printing, such as product and or discount coupon information can also be supplied by, for example, a network server providing data directly to printer 200 using the communication controller 396, or indirectly through the host POS terminal. The supplemental data for printing may vary depending upon the goods or services sold, an in-store, chain-wide or manufacturer special, identification of the customer, and/or one or more other transaction aspects.

Although particular reference has been made to certain embodiments, variations and modifications are also envisioned within the spirit and scope of the following claims.

What is claimed is:

1. A printer comprising:

print head for printing on media, wherein the media produces debris;

platen having a side for feeding the media along a path past the print head; and debris control member in contact with the media, wherein the debris control member further comprises a coating for attracting debris and the coating additionally is for lubricating the print head.

2. The printer of claim 1, wherein the debris control member collects the debris from the media.

3. The printer of claim 2, wherein the debris control member is located upstream of the print head along the path of the media.

4. The printer of claim 2, wherein the debris control member comprises a fibrous material having a non-uniform surface for collecting debris.

5. The printer of claim 4, wherein the fibrous material comprises felt.

6. The printer of claim 1, further comprising another print head and another platen for printing on opposite sides of the media.

7. A printer comprising:

a print head for printing on media, wherein the media produces debris;

a platen having a side for feeding the media along a path past the print head; and a debris control member in contact with the media, wherein the debris control member repels the debris, causing the debris to remain with the media.

8. The printer of claim 7, wherein the debris control member is on the side of the platen.

9. The printer of claim 8, wherein the debris control apparatus comprises stippling.

10. The printer of claim 9, wherein the debris control member further comprises a coating for repelling the debris.

11. The printer of claim 7, further comprising another print head and another platen for printing on opposite sides of the media.

12. A printer comprising:

a print head for printing on media, wherein the media produces debris;

a platen having a side for feeding the media along a path past the print head; and a debris control member located upstream of the print head along the path of the media for collecting the debris from the media, the debris control member including a fibrous material having a non-uniform surface, wherein the debris control member further comprises a coating for attracting the debris and for lubricating the print head.

13. A printer comprising:

a print head for printing on media, wherein the media produces debris;

a platen having a side for feeding the media along a path past the print head; and a debris control member on the side of the platen including stippling, wherein the debris control member further comprises a coating on the side for repelling the debris.

* * * * *